United States Patent [19]

Batchelder

[11] Patent Number: 4,852,454

[45] Date of Patent: Aug. 1, 1989

[54] METHOD AND APPARATUS FOR DELIVERING ELECTRIC CURRENTS TO REMOTE TARGETS

[76] Inventor: J. Samuel Batchelder, 412 Benedict Ave., 1A, Tarrytown, N.Y. 10591

[21] Appl. No.: 119,182

[22] Filed: Nov. 10, 1987

[51] Int. Cl.[4] ..... F41F 1/00

[52] U.S. Cl. ..... 89/1.11; 361/232

[58] Field of Search ..... 89/1.11; 361/231, 232; 273/84 ES; 43/112; 164/462

[56] References Cited

U.S. PATENT DOCUMENTS

| | | | |
|---|---|---|---|
| 2,976,590 | 3/1961 | Pond | 164/462 |
| 3,374,708 | 3/1968 | Wall | 89/1.11 |
| 3,523,538 | 8/1970 | Shimizu | 361/232 |
| 3,752,211 | 8/1973 | Kuniyasu et al. | 164/462 |
| 3,780,153 | 12/1973 | Privott, Jr. et al. | 164/462 |
| 3,803,463 | 4/1974 | Cover | 89/1.11 |
| 3,971,292 | 7/1976 | Paniagua | 89/1.11 |
| 4,006,390 | 2/1977 | Levine | 361/232 |
| 4,076,637 | 2/1978 | Hurst | 264/15 |
| 4,178,985 | 12/1979 | Sauvage | 164/462 |
| 4,453,196 | 6/1984 | Herr | 89/1.11 |

FOREIGN PATENT DOCUMENTS

| | | | |
|---|---|---|---|
| 1933054 | 1/1971 | Fed. Rep. of Germany | 89/1.11 |
| 2551668 | 6/1977 | Fed. Rep. of Germany | 89/1.11 |
| 166144 | 8/1985 | Japan | 164/462 |

*Primary Examiner*—Deborah L. Kyle
*Assistant Examiner*—Stephen Johnson
*Attorney, Agent, or Firm*—Mark P. Stone

[57] ABSTRACT

The present invention provides a nonlethal weapon for delivering an electrical current to a remote biological target for the purpose of incapacitating the target. The weapon includes a reservoir of metallic or metallic alloy material which is solid at ambient temperatures but which is maintained in molten or liquid form by a heater within the weapon. The molten metal or metallic alloy is ejected from the housing of the weapon by a trigger which applies hydraulic pressure to the material within the weapon. The hydraulic pressure propels two separate and isolated liquid streams of the molten material at the target through suitably provided nozzles. The streams, which solidify as a result of ambient temperature after ejection from the housing, provide electrical conductors which couple the weapon to the target. A source of electrical potential within the weapon is applied to the ejected conductive streams to complete a circuit between the weapon and the target for causing an incapacitating electric current to flow through the target.

20 Claims, 5 Drawing Sheets

FIG. 5
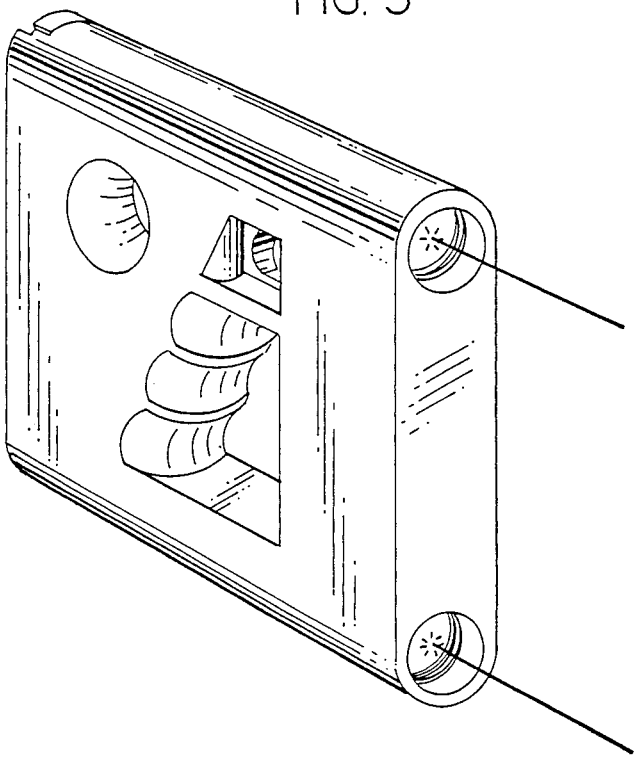
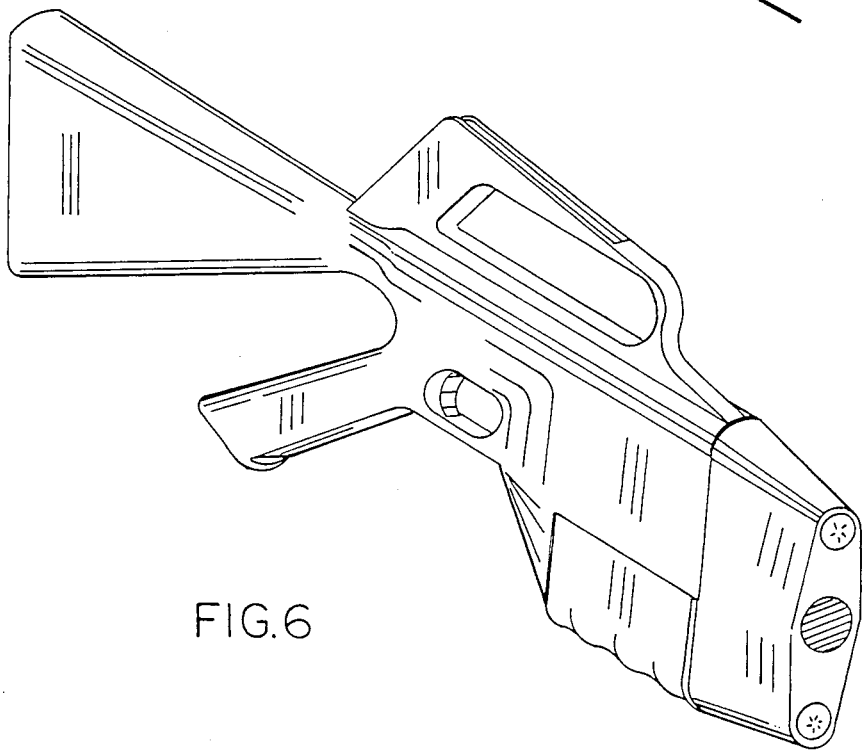
FIG.6

FIG. 7
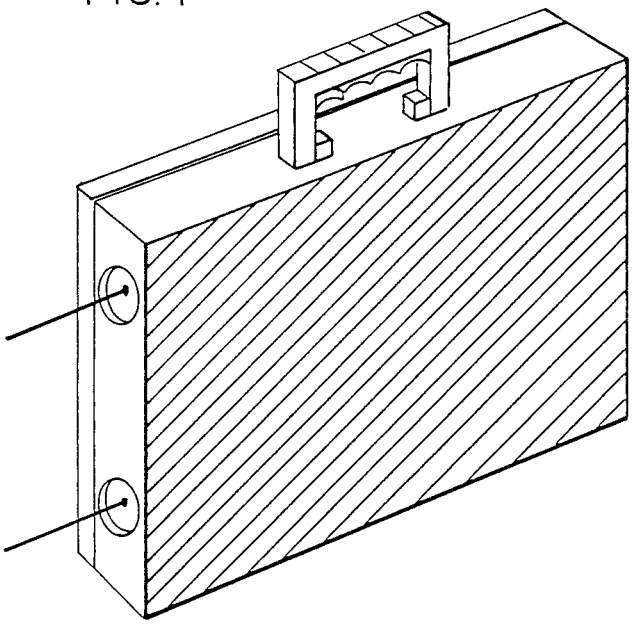
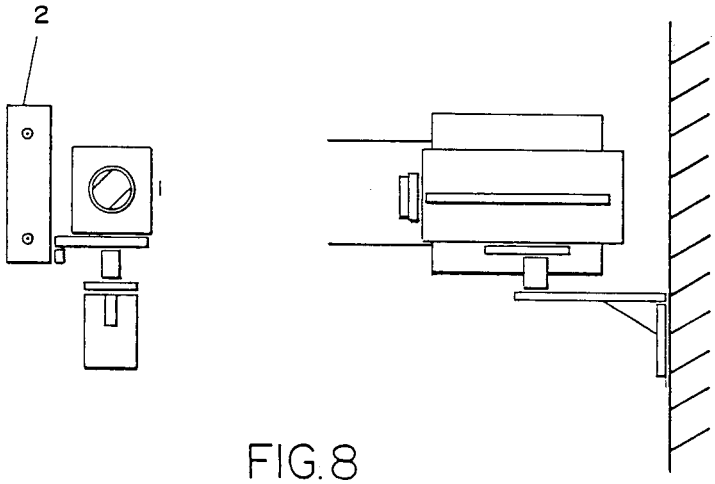
FIG. 8

FIG. 9
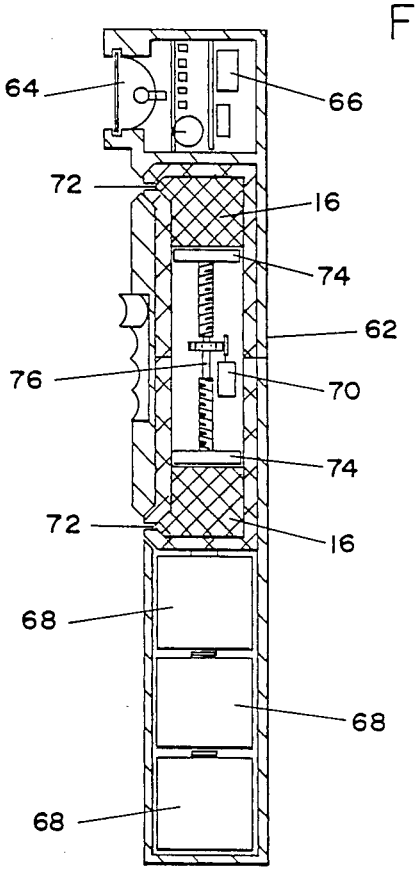
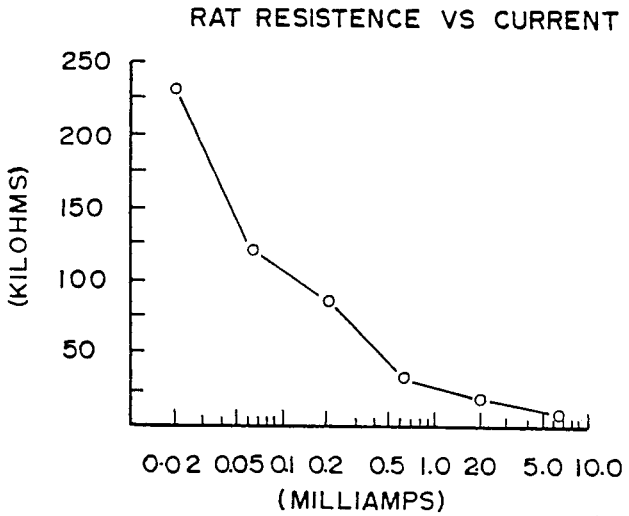
FIG. 10

METHOD AND APPARATUS FOR DELIVERING ELECTRIC CURRENTS TO REMOTE TARGETS

BACKGROUND OF THE INVENTION

The present invention is directed to nonlethal weapons adapted to cause an electric current to flow through a remote biological target for the purpose of incapacitating the same.

The general concept of a weapon adapted to deliver a nonlethal quantity of electrical current to a remote target for incapacitating the target is both simple and well-known to the art. The basic components of such weapons include a housing for maintaining a reservoir of an electrical conductor, means for ejecting or otherwise moving an electrical conductor into contact with the intended target, and means for applying a potential difference across the electrical conductor for completing a circuit with the intended target for delivering electrical current thereto.

Notwithstanding the existence of such devices in the prior art, each of the known devices includes a significant drawback. A first type of known device uses one or more liquid streams to make electrical contact with the target. Such a device is illustrated by U.S. Pat. No. 3,374,708. The difficulties with this type of device are that ionic conduction (electrolytes) provides inadequate electrical conductivity; liquid beams will break up into droplets after a short range due to capillary instability; large beam diameters are required for reasonable conductivity thereby decreasing the range of the weapon; large beam diameters require that the weapon include a reservoir sufficiently large to accommodate a large quantity of fluid thereby limiting the portability of the weapon; and the target is drenched with liquid which might short circuit the target.

The second type of device, as illustrated by U.S. Pat. No. 3,803,463, discloses a similar weapon in which two (2) small projectiles are fired at a target. Each projectile is attached to a fine conductive wire for delivering current to the target. The major drawback of this type of device is that it provides for only a single shot without reloading. The weapon is of small value if being used against more than a single assailant, if one of the projectiles misses the target, or if the target is able to remove one or both of the wires before the electric current is delivered. It is additionally noted that the projectiles are fired with a nitro powdered charge, thereby making the weapon a firearm, subjecting it to all applicable restrictions on firearms. Finally, because the solid wires are fired from a reel, the "shape memory" of the coiled wires may impede the range and accuracy of the device.

U.S. Pat. No. 3,971,292 illustrates a similar type device which employs mercury, a metal which is liquid at ambient temperature, as the electrical conductor. The drawbacks of such apparatus are that mercury is a toxic material, and the liquid beams of mercury will break up into droplets after propelled a short distance from the weapon due to capillary instability. Other disadvantages of the specific device disclosed in this patent are that the weapon is designed with the capability to kill; the electrical contact to the beams of the conductive medium is made inductively by windings around the exhaust nozzles; and the device is designed only to fire a single shot without reloading because the beams of conductive material cannot be turned off.

A fourth type of weapon is disclosed by U.S. Pat. No. 4,006,390. This patent discloses a mechanical derivation of a cattle prod, in which two shocking electrodes are spring biased and selectively urged forward several feet when activated. The major drawback of this device is that due to mechanical considerations, the effective range of the device is small, and therefore the operator must be in close proximity to the target in order to effectively deliver an electrical current.

It is an object of the present invention to provide a method and apparatus for delivering an electrical current to a remote biological target, said method and apparatus employing materials having high electrical conductivity and being capable of operating at relatively long ranges, firing a plurality of times at the same or different targets without reloading, and not requiring that a large reservoir of conductive material be maintained within the weapon. As discussed herein, this object is achieved by employing a metallic or metallic alloy conductor, which is solid at ambient temperature, but which may be propelled in liquid form from a heated reservoir of the weapon and solidifies as a result of exposure to ambient temperature after it has been ejected from the weapon at the target. As will be apparent from the foregoing discussion, the method and apparatus of the present invention utilizes the advantages of both liquid and solid conductors but eliminates the drawbacks associated with each.

SUMMARY OF THE INVENTION

In accordance with the present invention, a nonlethal weapon for delivering an incapacitating electrical current to a remote biological target includes a thermally insulated housing enclosing a reservoir of conductive material, such as a pure metal or metallic alloy, which is ordinarily in solid form at the ambient temperature range in which the weapon will be used. The housing includes heating means, such as a plurality of heating coils, surrounding the reservoir to heat and maintain the conductive material therein in molten or liquid form. The housing itself is thermally insulated to avoid heat loss from the molten material. The device further includes means for applying hydraulic or mechanical pressure to the reservoir for the purpose of ejecting the molten material in a liquid beam or stream through a suitably provided discharge nozzle at the front of the housing. Such ejection means may include a movable cylinder head adapted to be selectively urged against the reservoir by hydraulic pressure for the purpose of increasing the pressure within the reservoir causing ejection of a beam of material. The weapon includes two separate reservoirs of conductive material which simultaneously eject two separate and isolated beams through two separate nozzles. An output voltage supply is electrically coupled to the conductive material in each of the two separate reservoirs for applying a potential difference across the two conductive beams as they are ejected from their respective nozzles.

In operation, the two separate beams of conductive material are simultaneously ejected from the weapon at a remote biological target. Because the beams consist of or include metallic or metallic alloy material which is solid at ambient temperature, the beams solidify after they are propelled from the housing, and result in two solid metal conductors striking the target. (For very short ranges, the conductors will strike the target in liquid form if the flight time is less than that necessary for solidification). The potential difference applied across the conductors by the output voltage source is also applied across the target, completing an electrical circuit and causing electrical current to flow through the target.

The advantages of the present invention include the use of a material consisting of or including a metallic or metallic alloy conductor which provides good conductivity between the weapon and the target; the solidification of the conductors after they are discharged from the weapon to enhance the stability of the circuit between the weapon and the target and to further eliminate the problem of capillary breakdown which occurs when an exclusively liquid conductor is employed; the ability to fire more than a single shot without reloading which is absent from a weapon which uses an exclusively solid conductor; and an increased range of the weapon resulting from the discharge of the conductive material from the housing in a purely molten form. It is apparent that a weapon in accordance with the present invention efficiently employs the beneficial aspects of the known devices using both liquid and solid conductors, but eliminates the drawbacks inherent in each of the different type known devices as previously discussed.

BRIEF DESCRIPTION OF THE DRAWINGS

FIG. 5 illustrates a first embodiment for the exterior design of the nonlethal weapon in accordance with the present invention;

FIG. 6 illustrates a second embodiment of the design of the exterior of a nonlethal weapon in accordance with the present invention;

FIG. 7 illustrates a third embodiment of the design of the exterior of a nonlethal weapon in accordance with the present invention;

FIG. 8 schematically represents a combination of the nonlethal weapon in accordance with the present invention together with a surveillance camera;

FIG. 9 illustrates, in section, a further embodiment of the nonlethal weapon in accordance with the present invention in combination with a flashlight; and FIG. 10 is a chart illustrating that the resistivity of a living body is highly non-linear with electric current applied thereto.

DISCUSSION OF THE BEST MODES FOR CARRYING OUT THE INVENTION

Figure 1:
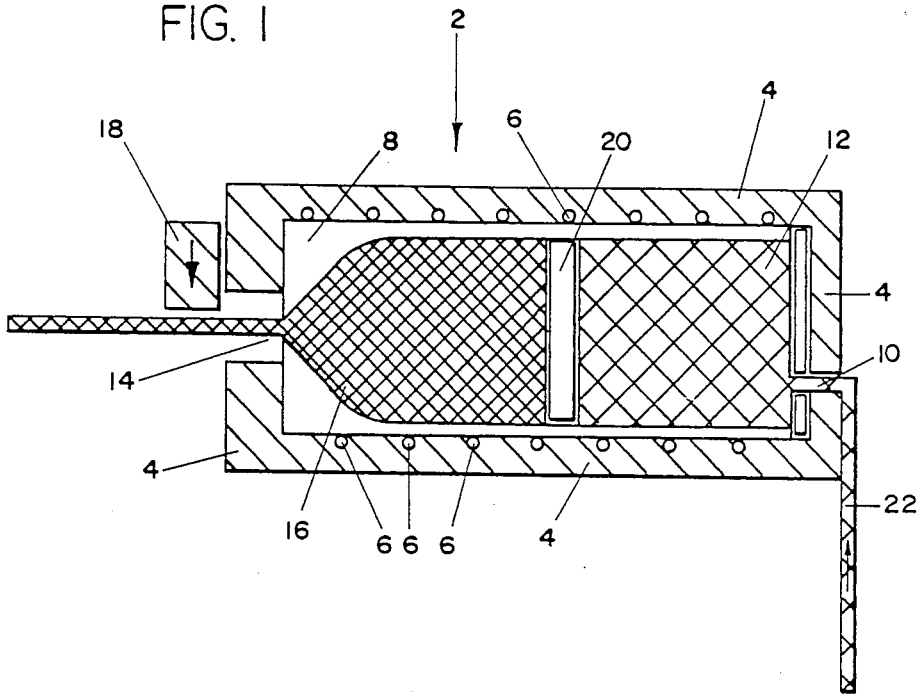
FIG. 1 of the drawings is a sectional view of the design of a preferred embodiment of the cylinder of a nonlethal weapon in accordance with the present invention.

The basic principle underlying the present invention, namely the use of conductive liquid streams to transmit electrical current to a remote target, is well-known to the prior art. However, as discussed more fully above, known devices employing this concept each includes certain distinct disadvantages. In accordance with the present invention, the disadvantages of the known devices have been overcome by providing a method and apparatus for ejecting a material having good electrical conductivity, such as a metal or metallic alloy, in a jet or liquid stream which solidifies after it is expelled from the weapon as a result of exposure to ambient temperatures to provide solid conductive wires disposed between the target and the weapon. The object of the weapon is to complete an electrical circuit with the target and deliver an incapacitating, but nonlethal, electric current therethrough.

Before discussing the physical embodiments of the present invention, it will be helpful to discuss theoretical considerations underlying the principles of operation of the invention. The basic premise of the subject invention is to provide a nonlethal weapon. Stimulation of the nervous system of a human being by electrical current will generally produce three different levels of pain, namely bearable pain, unbearable pain and black out pain, dependent upon magnitude and frequency of the peak electrical current delivered. For example, alternating polarity 1 m.s.e.c. electrical pulses of 80 m.a.m.p. magnitude and 100 Hz frequency will generally result in black out pain, although this level may vary depending upon whether the peak current is delivered immediately or whether the peak level is reached by a gradual ramp. It is also known that the resistivity of a body is not independent of electrical current applied thereto, but the resistivity drops significantly as the peak electrical current delivered to a body increases. (See FIG. 10 of the drawings). The physical cause of this effect is not precisely known. However, this effect becomes an important consideration in the design of a nonlethal weapon in that the weapon must have a self-limiting maximum value of electric current to be delivered to the target and not be designed to feed back on the voltage drop sensed in the target. Needless to say, the maximum current delivered by the weapon must be limited to a value which will temporarily incapacitate the target but not result in permanent physical injury. Studies tend to indicate that in order to maximize the incapacitating impact of a nonlethal weapon of the type described herein, and to minimize its possible physical impact, electric current should be delivered in a low duty cycle sequence of intense current pulses. To insure black out of the targeted subject, peak currents of one hundred milliamps are required which should be delivered in 0.1 millisecond pulses at a ten Hz repetition rate, providing an average current of one milliamp, thereby providing a considerable safety margin against permanent injury.

Another theoretical consideration which is significant to the design of a nonlethal weapon of the type described herein is the electrical conductivity of the ejected stream of liquid. The beam resistance, high voltage and power consumption of a high voltage generator of the weapon must be designed for peak current requirements within the parameters discussed above. To prevent excessive power from being dissipated in the beams themselves (and thus not reaching the target), a good design rule is that the resistance of the beams should not exceed the resistance of the target. Assuming that the weapon will have a fifty foot range and the target will have a forty K ohm resistance, the resistance of the beam of conductive material should not exceed about fifteen ohms per centimeter.

Liquid beams, as exemplified by some of the prior art previously discussed, have historically been considered to be dielectric liquids in which ionic conduction carries the current. The conductivities of good electrolytes can be as high as 0.2 mhos/cm (20% NaCl in water at 25° C.). A material having a conductivity of one mho per cm would produce a one ohm resistance if a cubic centimeter is placed between two conducting planes separated by one centimeter. This would result in an acceptable beam resistance (15 ohms per centimeter) for a beam having a diameter of 0.65 centimeters. Assuming a beam velocity of 20 meters per second, each liquid beam would have to produce almost three cups of liquid per second to result in a continuous conductive stream. Such rapid depletion of the liquid supply, together with the possibility that such a large volume of liquid will drench the target with conductive solution thereby shorting out the stunning current, renders a pure liquid beam impractical for moderate and long range use in a weapon of the type adapted to deliver an electric current to a target.

In order to improve conductivity of ionic conduction discussed above, electrically conductive particles might be added to the beam materials so that the current might be carried entirely or in part by electronic conduction in these particles. For example, graphite particles are embedded in a polymeric fiber core in standard automotive ignition harnesses. The effective conductivity of the combination is about 0.3 mhos/cm., or almost the same as a pure electrolyte. The reason that such conductivity is much lower than solid graphite (730 mhos/cm.) is that electric current must traverse a tortuous path from one particle to the next. Adding electrolyte to the particles to reduce the tortuous path provides little advantage because of the nonlinear voltage-current characteristics of the particles/electrolyte interface. Roughly speaking, there is a few tenths of a volt drop each time the current enters or leaves the electrolyte, and the combined effect creates a large cumulative voltage drop in a long beam. Therefore, mixed ionic and electronic conduction, as described above, is not practical for a beam in a weapon as a result of the large voltage drop occurring along the beam.

As a result of the shortcomings of ionic conduction and mixed ionic and electronic conduction, a weapon in accordance with the present invention preferably will employ metallic beams consisting of pure metal or metal alloy as the conductive elements. A pure metal or metallic alloy will readily satisfy the resistance requirement noted above by generating a beam having a resistivity of 15 ohms per centimeter or less. As an example, pure lead, a relatively poor conductor for a metal, would have to be ejected with a beam diameter of 13 microns before it exceeds the resistivity constraint. Certain conductive plastics such as iodine doped polyacetylene have good electronic conduction properties and might also be adapted for use as the material for conductive beams in the subject weapon.

Although metals provide excellent material for conductive beams for use in the subject invention, there are drawbacks in using metallic conductors ejected from the weapon in solid form. In the first instance, because of shape memory in a wire, it is difficult to eject solid wire unreeled from a spool or coil in a straight line. Moreover, the use of solid wire on a spool in a weapon of the type under discussion effectively limits the weapon to a single shot. If the target is missed, or if the wires are ripped from the target, it is necessary to either reel in the wires or reload the weapon with new spools before a subsequent shot can be fired.

As a result of the above drawbacks, the present invention employs a metallic conductor which can be ejected from the housing of the weapon in liquid or molten form. However, the material is selected so that the liquid beams solidify in the flight towards the target.

With the understanding that electronic conduction is preferable in the present invention, yet it is impractical to eject solid conductors from a weapon, the choice of beam material becomes dictated by the characteristics of the available conductive alloys. Mercury, cadmium, sodium, potassium and thalium are used in a variety of low temperature alloys, but cannot safely be used in the subject weapon because of carcenogenic effects. With this consideration in mind, two categories of alloy materials become preferable for use in the subject invention, namely - indium - gallium based alloys, and bismuth based alloys. Both of these alloys require heating to be liquid in the ambient temperature range in which the weapon of the subject invention would typically be used. It has been found that it is possible to eject a liquified alloy from a nozzle and have it cooled to form uniform wire while in ballistic flight. More specifically, an alloy consisting of 40 percent bismuth, 20 percent lead, and 40 percent tin by weight heated to a temperature of 245° F. has been ejected through a 90 micron nozzle at a velocity of six meters per second into ambient room temperature and has formed contiguous wire in excess of 100 feet long.

The alloy must be cooled quickly and evenly with distance from the nozzle, and must have no significant change of volume during its phase transition from liquid to solid. If one side of the liquid beam cools first, it will distort the resulting wire into a spiral shaped; if sections of the wire solidify with molten regions between them, strains and air turbulence can accumulate to break apart the sections at those melted regions; and if the alloy contracts on solidification, the result is a rigid cylindrical sheath around a liquid core under compression, placing the wire under tension and forcing the molten core to burst through the sheath in a barb-like structure. If an alloy beam is ejected into air that is at nearly the same temperature as the molten alloy, the time required for the beam to solidify will be long compared to the flight time, but the effect of capillary break up (discussed hereinafter) will add a restriction to the effective range of the conductive beam.

A eutectic alloy may also be employed as the conductive beam material in the subject weapon. A useful alloy is one that will produce a mixed composition of liquid and solid as the alloy is cooled, so that the effective viscosity is increased once the alloy is ejected out of the nozzle. The advantage of using this kind of an alloy is that the effective viscosity can be low for the liquid beam emerging from the nozzle so that the pressure required for ejection is tolerable, but the viscosity increases sharply as the liquid beam is ejected into the ambient environment and solidifies to dampen the capillary wave break up phenomenon. As an example, an alloy consisting of 40 percent tin and 60 percent lead is fully liquid at 460° F. As it is cooled, lead crystals precipitate out of the melt such that the beam concentration becomes 63 percent tin and 37 percent lead at 360° and below as the beam solidifies.

As another theoretical consideration, the phenomenon of magnetohydrodynamic stabilization may be employed to improve the stability of the liquid alloy beam emerging from the nozzle of the subject weapon. If a magnetic field is imposed on the nozzle of the weapon so that the field lines run perpendicular to the direction that the liquid alloy is ejected from the nozzle, and if the nozzle and the alloy are formed from materials which are reasonably good conductors, a force develops that tends to flatten the velocity profile in the nozzle which will result in a plug flow. The effect of magnetohydrodynamic stabilization increases as the conductivity of the alloy increases, the strength of the applied field increases, and the velocity of the ejected alloy increases.

Other theoretical considerations in the design of a weapon of the type described herein are limitations on the dimensions of the beam of conductive material ejected from the nozzle. Metal beam diameters as small as 13 microns will have sufficient conductivity to operate satisfactorily. The primary consideration involved in determining the minimum beam diameter is the effective drag which increases as the diameter increases. For reasons of both electrical resistivity and drag, the minimum operable diameter of a conductive beam is preferably between 13 and 70 microns.

The maximum beam diameter is determined by the thermal cooling capacity of the ambient air into which the beam is ejected. The higher the melting point of the ejected alloy, the larger the beam diameter can be and still achieve solidification in a timer shorter than the break up time of the beam. The upper limit on the beam diameter is therefore set by the upper practical limit on the alloy melting point. Assuming that the melting point of the beam should be less than 200° C., the maximum preferable beam diameter will be about 1.2 millimeters. Greater temperatures and beam diameters might be necessary for longer ranges.

The beam temperature limits are set by several considerations. Excessive temperatures cause the housing of the weapon in which the molten beam material is stored to dissipate substantial heat in the ready mode, thereby requiring the housing of the weapon to include a substantial quantity of thermal insulation to protect both the user and the remainder of the weapon. Additionally, excessive temperatures may result in severe burns to the target if large quantities of molten material are ejected on the target at close range. As a practical consideration, the material used as a conductive beam in the present invention preferably will have a melting point of no greater than 200° C.

The lower limit of the beam temperature is determined primarily by the speed of solidification of the material. Preferably, the lower limit of the melting point of the conductive material should be above 0° C., as for example, indium-gallium mixtures. In any event, the beam material is solid or will solidify at the ambient temperature in which the weapon is expected to be used.

Beam density should be relatively high because high density reduces the impact of air drag on the range of the ejected beam. Preferably, the density of the beam material should be greater than six, and should have a conductivity greater than 2000 mhos/cm. Similarly, it is beneficial to use a beam material having a reasonably high viscosity to reduce turbulence in the ejected beam. Preferably the beam material should also have as low a surface tension as possible because surface tension is a force tending to cause break up of the ejected liquid beam.

Four factors which determine the effective range of a conductive beam ejected from a weapon are velocity, arc, spacing uniformity, and continuity. The nozzle velocity of the ejected liquid beam is a function of the drive pressure, the nozzle design, the density, and the alloy viscosity. To reduce turbulence generated by the nozzle which will tend to exerbate capillary instability of the ejected beam, the flow in the nozzle should have a Reynolds number of less than a million. The stability of the flow is sensitive to the precise nozzle configuration, initial turbulence in the reservoirs holding the beam material, impurities in the beam material, vibration, and pressure uniformity. There are several different approaches in calculating what an acceptable time of flight is for a beam to reach its target. Preferably, a flight time of no greater than 0.2 seconds is required so that the ejected beam will hit its intended target before the target can react. Therefore, if the intended target range is ten meters, beam velocity should be 50 meters per second to result in a flight time of 0.2 seconds. Apart from the above, flight time of the beam is also constrained by the time necessary for the beam to rise and fall about 0.6 meters to avoid impact of the beam against overhead structures such as ceilings in indoor uses of the weapon. This limits the flight time of the beams to about 0.5 seconds so that the maximum range is approximately 0.5 times the nozzle velocity. Accordingly, a ten meter indoor range requires a beam velocity of about 20 meters per second.

Spacing uniformity of ejected beams is achieved by regulating the beams to have the same initial direction and velocity. Adjustable nozzles of reasonable precision achieve initial pointing tolerances sufficient to maintain a beam spacing of 15± seven centimeters over a 15 meter range. If the viscosities of the two ejected conductive beams are the same, hydrostatic pressure can be applied equally to both reservoirs holding the conductive molten beam material so that the initial velocities of the ejected beams are also held to similar tolerances. It is axiomatic that sufficient spacing of the isolated beams must be maintained throughout the effective range of the device to avoid arcing or short circuiting of the electric current transmitted towards the target through the simultaneously ejected conductive beams. Capillary wave instability is a phenomenon by which a cylindrical jet of liquid is unstable and will break up into small droplets such that the volume in each droplet is equal to approximately the volume in a section of the original cylinder that is nine times as long as its radius. This occurs because surface tension forces find it energetically favorable to reduce the local radius of curvature of the beam's surface by switching from a cylinder of one radius to a sphere with a larger radius. The phenomenon forms the basis of operation of most atomizers; if a liquid beam is ejected with a very small diameter, it will quickly break up into a mist of small droplets Such capillary wave instability is a fundamental limitation of weapons of the type described herein exemplified by the prior art in which pure liquid beams provide the conductive material and remain in liquid form after ejection from the nozzles of the weapon. In such devices, even if the beam emerges from a well formed laminar nozzle, capillary waves will form on the surface and break up the beam.

The instant invention seeks to overcome problems resulting from capillary wave instability in that although the conductive material is ejected from the nozzle in a liquid form, it rapidly solidifies into a solid conductor after it is exposed to ambient temperature. In addition to the above, two effects are useful in minimizing capillary wave instability. First, the viscosity of the beam material itself should be reasonably high to generally increase beam stability. Second, capillary wave instability can be reduced by applying a thin incompressible film, such as oil or an oxide, significantly decreasing the rate at which capillary waves grow thereby decreasing wave instability. The application of such film might be accomplished by choosing an alloy with a relatively rapidly oxidizing component, or by atomizing oil near the nozzle from which the molten alloy is ejected.

Additional theoretical considerations in the design of the subject weapon involve beam cooling. As discussed herein, the material employed for the conductive beam is preferably selected from materials which rapidly and uniformly solidify when exposed to ambient temperatures after ejection from the weapon. To enhance the cooling effect if necessary, an independent jet of cooling fluid, may be ejected together with and in close proximity to the conductive beams. The phenomenon of electrostatic cooling may also be used to enhance and accelerate the solidification of the ejected beams More specifically, when high voltage is applied to the alloy jets, the jets will cool faster and therefore produce more reliable wire. Such enhanced cooling occurs because ions are formed from the air at the surface of the charged alloy. These ions are repelled from the alloy, creating a wind of ions, or at least a light breeze. This, in turn, disturbs the thermal boundary layer that forms around the hot wire, in a way similar to air blowing from a fan.

Nozzle design is of significant importance for ejecting liquid streams from the weapon having the initial conditions necessary for effective conductivity, effective range, effective initial velocity and sufficient in-flight time to enable the beam to uniformly solidify. Additionally, because the conductive material is initially ejected from the weapon in liquid form but solidifies in flight, the material undergoes a phase transition. A filter may be employed proximate to and upstream from the weapon nozzle to filter out any material which has solidified prior to ejection to prevent clogging of the nozzle by particulate matter and providing ejected beams with uniform consistencies and initial conditions.

Four charts are provided at the conclusion of the specification to disclose applicable physical consistents of various metals which might be employed in the instant invention, standard low melt alloys which might be employed in the instant invention, applicable physical formulas utilized in the design of the subject invention, and an example of the operating parameters of a device in accordance with the subject invention when an indium/gallium alloy is employed as the conductive beam.

Having now described theoretical considerations underlying the present invention, a preferred physical embodiment will now be discussed with reference to the drawing figures.

FIG. 1 of the drawings illustrates a sectional view of a portion of the housing of a nonlethal weapon in accordance with the present invention. The housing is generally designated by the reference numeral 2. The outer portions 4 of the housing 2 are formed from or include thermally insulated material, and a heating coil 6 is provided proximate to a hollow pressure cylinder 8 defined within the housing The rear portion of the housing defines a port 10 to accommodate the flow of hydraulic oil into the pressure cylinder 8. The forward portion of the housing defines a second port 14 through which a molten alloy or a pure molten metal 16 within the pressure cylinder 8 may be ejected from the housing. An insulating cover 18 is selectively moveable over the port or nozzle 14 to either cover the port when the device is not in operation or to expose the port to permit ejection of molten material when the device is in operation. A moveable cylinder head 20 is disposed within the pressure cylinder and acts as a partition to separate the hydraulic oil 12 and the molten material 16, both of which are contained within the pressure cylinder. A fluid line 22 is coupled to the rear port 10 of the housing 2 to provide hydraulic oil in the pressure cylinder behind the moveable cylinder head 20. Although not shown in FIG. 1, a heat sensing device such as a thermistor or thermocouple is provided in the housing proximate to the conductive material 16 for monitoring the temperature thereof.

Figure 2:
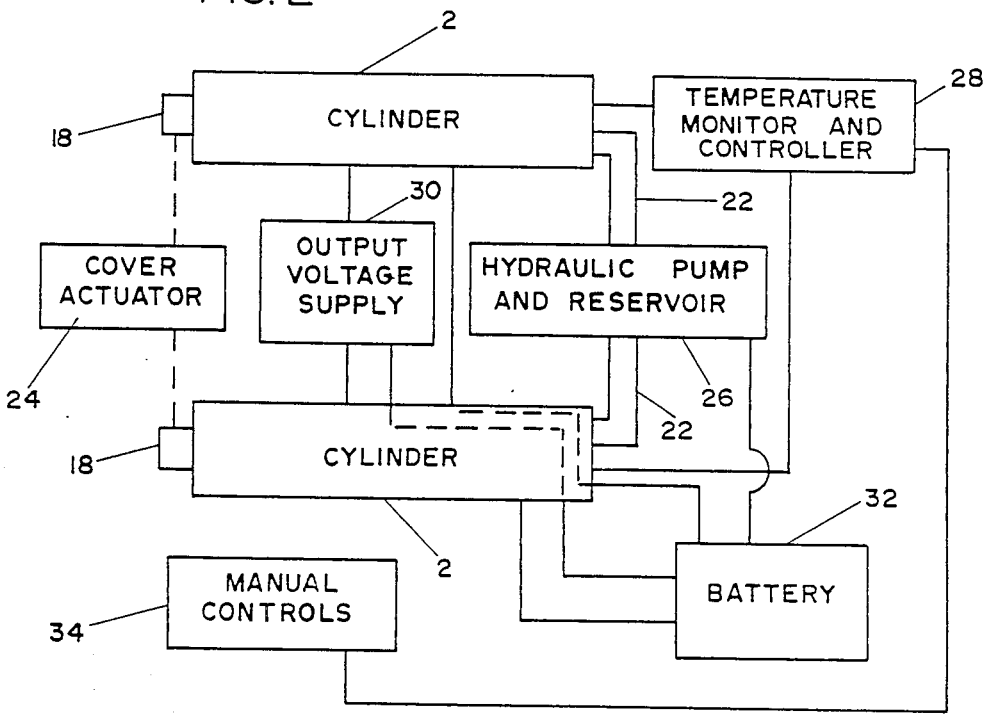
FIG. 2 is a block diagram of the different components of a nonlethal weapon in accordance with the present invention.

Referring now to FIG. 2 of the drawings, a block diagram of the apparatus in accordance with the present invention is disclosed. The apparatus includes at least two separate housings 2 spaced apart and electrically isolated from each other so that the device may simultaneously eject two separate, independent and isolated streams of molten conductive material. A cover actuator 24 is provided to remove the covers 18 from each of the nozzles of the housings 2 when the device is to be operated. A common hydraulic pump and reservoir 26 is disposed between the two housings 2 and is in fluid communication with each housing through line 22. Likewise, a temperature controller 28 including a heat sensor is electrically coupled to each of the cylinder housings 2 to provide a thermal feedback loop for controlling the temperature of the heating coils 6 to maintain the temperature of the molten material 16 in each housing 2 at the same predetermined level. An output voltage supply 30 is electrically connected to both of the pressure cylinders 8 to provide a potential difference across the electrically conductive material 16 contained within each of the housings 2. A battery 32 is provided as an electrical source for the output voltage supply 30, the heating coils 6 within the housings 2, and the hydraulic pump for pumping hydraulic fluid into the rear portions of the housings 2. In the alternative, hydraulic fluid may be pumped by manual controls 34 which also controls other functions of the device such as the cover actuator to remove the covers 18 from the nozzles at the front ends of the housings 2, the temperature controller 28 for energizing the heating coils 6 in the housings 2, and the output voltage supply 30 to apply a potential difference across the conductive material in the forward portions of the housings 2.

In operation of the invention described thus far, the forward portion of each of the pressure cylinders 8 of the housings 2 are loaded with a pure metallic or alloy source. The temperature controller 28 is actuated by the manual controls 34 to energize the heating coils 6 surrounding each of the pressure cylinders 8. The temperature controller is set to allow the heating coils 6 to melt the source material 16 in each of the housings 2 into molten form. The output voltage supply 30 is also actuated to apply a potential difference across the now molten material 16 in each of the two housings 2. During this pre-operation stage, the insulating covers 18 keep the forward nozzles 14 of each of the housings 2 closed to reduce heat leakage to the ambient.

When the weapon is to be fired, the insulating covers 18 are removed to open the nozzles 14. Thereafter, the operator moves the manual controls 34 to pump hydraulic oil from the reservoir 26, through lines 22, and into the rearward ends of each of the housings 2 through the respective rear ports 10. The hydraulic force generated by the pumping of the hydraulic fluid forces the moveable cylinder head 20 to move forward in each of the pressure cylinders 8 to eject the molten material in a stream through the forward nozzles 14 defined in each of the housings 2. It is noted that the moveable cylinder head completely isolates the hydraulic oil in the rear of the pressure cylinder from the molten material in the front of the pressure cylinder so that only molten material, and not hydraulic oil, is ejected through the forward nozzle 14. In this manner, the apparatus may operate in any orientation.

As a result of the above steps, two separate, spaced apart streams of molten material are simultaneously ejected from the device. Output voltage supply 30 applies a potential difference across the two ejected streams. When the streams strike a common target, the target completes an electric circuit with the device so that an electric current is delivered to the target. As discussed fully above, the ejected streams are formed from electrically conductive material and are selected so that they solidify in flight as a result of exposure to the ambient temperature outside of the device. Preferably the nature and quantity of the material 16 in each of the housings 2 is the same. Heating these materials to the same temperature, and simultaneously applying the same hydraulic pressure to the rear of each pressure cylinder to eject the respective materials through identically configured nozzles, results in each of the two ejected, spaced apart streams having the same characteristics (e.g. the same conductivity, the same initial velocity, the same beam diameter). In this regard, it is noted that the respective housings 2 are identically configured; the respective nozzles 14 at the forward ends of each of the housings are identically configured; each of the rearward ports 10 is of the same dimension; each of the lines 22 leading from the hydraulic reservoir are of the same length, diameter and configuration; and there is a common hydraulic reservoir holding the same hydraulic fluid 12 for both housings 2 so that actuation of the pump means applies the same hydraulic force into each of the pressure cylinders 8. In this manner, uniformity of the two ejected streams is maintained.

Figure 3:
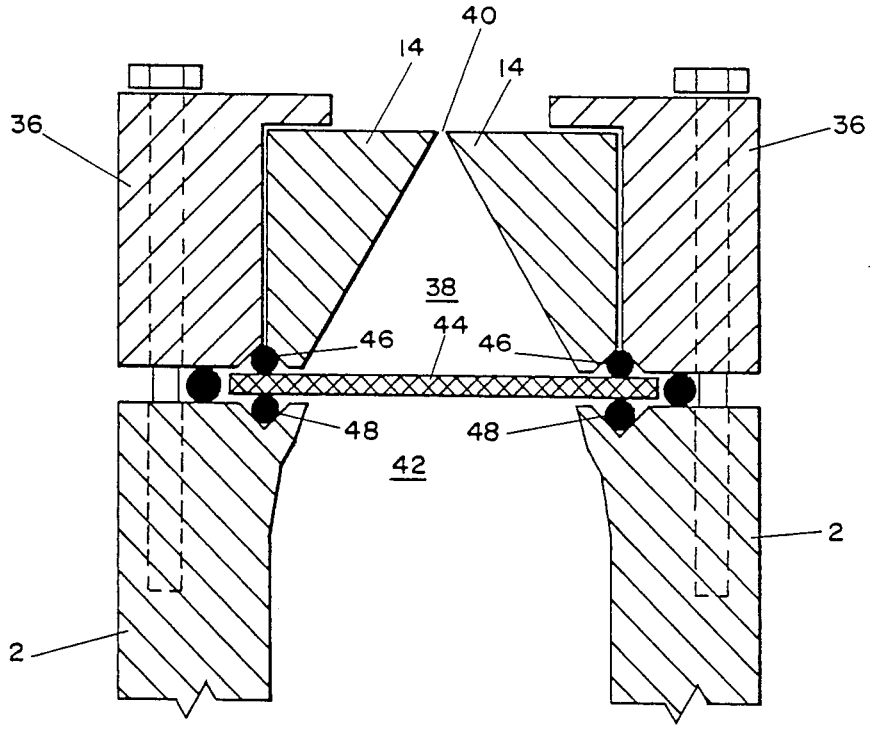
FIG. 3 illustrates the nozzle portion of the nonlethal weapon of the present invention in section.

FIG. 3 of the drawings represents the preferred embodiment of the design of the nozzles 14 which are defined at the forward end of each of the housings 2. As illustrated in FIG. 3, the nozzle 14 may be mounted to the forward end of each housing 2 by a nozzle retainer 36, which itself may be bolted into the housing Preferably the nozzle is formed from hardened steel. The design of the nozzle is significant to the overall operation of the weapon of the present invention. Any turbulence imparted to an ejected beam of conductive material will increase as the ejected beam propagates through the air, and will result in breakup of the wire if complete solidification has not first occurred. In order to assure that the wire has sufficient time to solidify, the initial conditions of the beam need to be as uniform as possible. In designing an optimum nozzle for the present invention, it was determined that the nozzle should terminate abruptly at the point of highest velocity (smallest or final orifice), and any radius of curvature or cylindrical section at the final orifice should be small compared to the diameter of the orifice. Additionally, the final orifice should be circular or regular, with no substantial burs or nicks, and any inherent irregularities resulting from the manufacture process must be small compared to the diameter of the orifice. The tapered section preceding the final orifice should be smooth and uniform from the final orifice to a diameter where the flow of fluid has a Reynolds number of less than approximately 1,000. Tapered angles ranging from half angles of 30° to 41° have been successful, and it is likely that angles between 15° and 90° may also be successful. Flow measurements have found 21° to be an optimal angle (See *Review Of The Stability Of Liquid Jets And The Influence Of Nozzle Design, M. J. McCarthy et al, The Chemical Engineering Journal,* 7 (1984), pp. 1–20). Finally, the nozzle must be made from a sufficiently hard and durable material that it can resist the expansion of a bismuth alloy if such alloy solidifies in the nozzle. Bismuth alloys containing more than 30 percent bismuth usually expand after solidification. It has been found that a nozzle formed from glass or hardened tool steel is sufficiently durable to withstand such expansion.

One difficulty in manufacturing nozzles which are useful for the present invention is that such nozzles must define an orifice which is sufficiently small in diameter to eject a small diameter stream which is optimal for beam cooling. A three mil (75 micron) diameter stream requires a nozzle that is smooth and uniform to roughly ten microns. A good technique for the manufacture of such precision nozzles is to heat a glass tube until the glass collapses to create an internal uniform taper in the tube down to zero diameter. Cleaving the tube at the solid section and grinding the glass perpendicular to the axis of the tube reveals a small sharp orifice which satisfies the above noted requirements.

Referring back to FIG. 3 of the drawing, it can be seen that the cavity 38 defined by the nozzle 14 smoothly and uniformly tapers in a forward direction to define a small centered orifice 40. The rear portion of cavity 38 is contiguous with the forward space 42 of the pressure cylinder of the housing 2. The pressure cylinder is generally uniform in diameter, but conically tapers inwardly proximate to the area where it meets the nozzle to provide a gradual transition. In this manner, molten material flowing from the cylinder body through the nozzle and out from the orifice is provided with a natural stream line of flow and there is no radius of curvature or cylindrical section at the orifice 40.

For general information relating to nozzle design for optimum flow, attention is directed to the aforementioned McCarthy, et al article, the disclosure of which is expressly incorporated herein by reference.

Again referring to FIG. 3, a filter 44 is disposed between the intersection of cylinder space 42 and nozzle space 38. The filter may be mounted at this junction by two O-rings 46 and 48 received within appropriately defined circumferential grooves in the housing 2, the nozzle retainer 36 and/or the nozzle 14. As noted, the orifice 40 defined by the nozzle 14 is preferably quite small to result in optimum conditions for ejection of molten conductive material therethrough to enhance the solidification of the ejected material, in accordance with the present invention. When dealing with small nozzles, the possibility that the nozzle will become clogged is also present. This is especially troublesome for a weapon, in which reliability is a significant consideration and in which the material ejected from the nozzle will undergo a phase transition.

Even if a particle of metallic oxide or other debris does not clog the nozzle, there is still a possibility that such particle may lodge near the final orifice 40. If this occurs, the presence of such particulate matter near the orifice may introduce turbulence into the flow of the ejected material. To overcome the problem of potential clogging or the introduction of turbulence, the preferred embodiment of the present invention mounts the filter 44 proximate to, but upstream from, the orifice 40. The use of a filter at this location tends to prevent clogging of the nozzle, tends to prevent the accumulation of particular matter proximate to the nozzle, serves to guarantee the cleanliness of the material ejected from the nozzle, and also creates a more uniform velocity profile across the diameter of the nozzle. Preferably, the filter should be placed close to the orifice 40 subject to two constraints. First, the flow per unit area of the filter should be sufficiently low so that the pressure drop across the filter won't damage the filter or consume excessive energy. Second, the filter should be positioned behind the nozzle and out of the region 38 defined by the uniform taper of the nozzle so that it is positioned in a region of low Reynolds number flow.

The filter may be formed from various different materials. Preferably, the filter will be formed from a rigid material capable of filtering particulate matter of ten microns in diameter or greater. Examples of such filter media are Pall Corporation H-100 and H-180 (sintered metal powder), PMM-150 (a composite of mesh powder), and FH-100 (sintered metal fiber composite).

Figure 4:
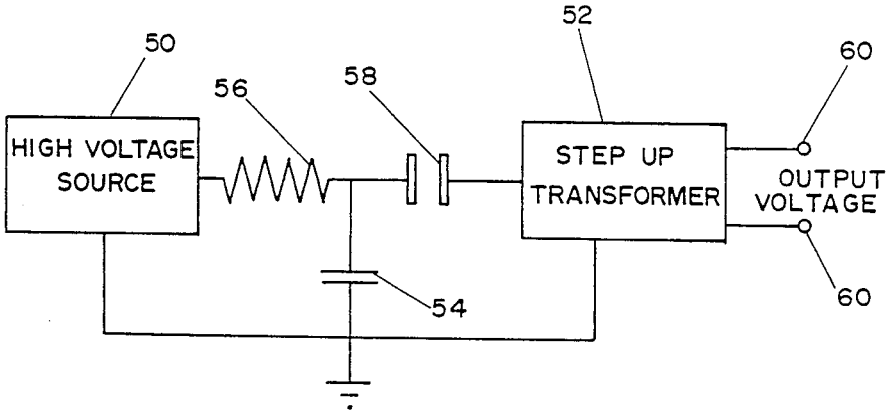
FIG. 4 illustrates a circuit diagram of the electrical drive circuit of the weapon of the present invention.

FIG. 4 of the drawings illustrates the preferred embodiment of a drive circuit forming the output voltage supply 30 of the present invention. While there are a number of methods for generating high voltage pulses, the most common is the Tesla coil design in which the breakdown of a spark gap (or other interrupter) closes a resonant circuit between a charged capacitor and the primary winding of a transformer. The secondary steps up the voltage and reduces the current. An example of such an electrical drive circuit is shown in FIG. 4. A high voltage source 50 can be an oscillator coupled to a first step-up transformer (not shown) within the source 50. An electrical current charges a storage capacitor 54 through an isolation resistor 56. When the voltage on the capacitor 54 reaches the breakdown voltage of the spark gap 58, the gap arcs over and the capacitor and a second step-up transformer 52 create a resonant circuit, resulting in an output voltage across terminals 60. The output voltage is equal to the input voltage (which may be provided by a battery, line voltage, or the first step-up transformer within the source 50) multiplied by the step-up ratio, minus loading losses in the transformer. Typically the time constant of this circuit is about ten microseconds, and the time constant for initially charging the capacitor is about ten milliseconds. The peak output current and voltage at terminal 60 is determined by the turns ratio and coupling constant of the transformer. The peak output current can be adjusted by varying the spark gap spacing, the output load resistance, the transformer coupling, or other known parameters.

FIGS. 5–9 show various embodiments of the external design for the subject invention. FIG. 5 illustrates a compact handgun design in which the two cylinders containing the conductive material (not shown) are mounted above and below a handgrip. Finger actuated switches are provided to operate the ejection of the molten conductive material and apply the high voltage means for providing a potential difference across the ejected stream. Batteries may be mounted both behind and in front of the handgrip.

FIG. 6 illustrates a rifle design for the subject invention. Hand operated switches for controlling the ejection of the conductive beams and the application of high voltage are provided.

FIG. 7 illustrates a briefcase configuration of the subject invention which is suitable for plainclothes patrols. As in the embodiments illustrated by FIGS. 5 and 6, hand controls are provided for operation of the weapon. One advantage of a briefcase type embodiment is that by virtue of the size of a standard briefcase, the weapon may hold a substantially large quantity of conductive material.

FIG. 8 illustrates the subject invention in combination with a remote alarm system, such as an infra red detector or an imaging detector such as a vidicon. Means may be provided for automatically actuating the weapon of the subject invention when the alarm is set off. The weapon may be mounted to the alarm so that conductive electrical beams are automatically ejected at the target on which the infra red detector has focussed.

FIG. 9 illustrates, in section, a combination of the weapon of the present invention and a flashlight. The upper portion of a housing 62 includes an electric lamp 64 and the necessary circuitry 66 for generating the high voltage (See FIG. 4). The lower portion of the housing contains a storage area for batteries 68 which are employed to energize the electric lamp, energize heating coils for melting a conductive material, and for energizing a motor drive 70. More specifically, conductive material 16 is stored in two separate, electrically isolated, areas of the central portion of the housing 62. Electric heating coils (not shown in FIG. 9 surround the areas in which the conductive material is stored for melting such material, in a manner similar to that discussed with respect to FIG. 1. The two reservoirs of molten material are maintained in separate areas in different portions of the housing 62. Each storage area defines a nozzle 72 through which molten conductive material may be ejected. The conductive material 16 stored in one area is isolated from the material stored in the other area by individual piston heads 74. Each piston head 74 is connected to a common shaft 76 which is rotated by the motor drive 70. Accordingly, when the motor drive is energized and the shaft 76 is rotated, the piston heads simultaneously apply a mechanical force to each of the two reservoirs to cause the conductive material in each to be ejected from their respective nozzles. Suitable hand controls are provided to the operator for actuating the flashlight, the heating coil, and the motor drive for operation of the weapon.

Other modifications and variations within the scope and spirit of the present invention will become apparent to those skilled in the art. Accordingly, the description of the preferred embodiments made above are intended to be only illustrative of the invention, the scope of the invention being defined by the following claims and all equivalents thereto.

I claim:

1. A non-lethal weapon for delivering an electric current to a living target, said weapon comprising:

a housing defining at least first and second separated storage areas electrically isolated from each other for storing an electrically conductive material, means for ejecting said electrically conductive material from said weapon in two separated liquid streams, one of said liquid streams being ejected from said first storage area and the other of said liquid streams being ejected from said second storage area, means for applying a voltage across said conductive material stored within said first and second storage areas for creating a potential difference across said two separated ejected streams of conductive material;

said conductive material existing in solid form at ambient temperatures such that said two separated liquid streams are caused to solidify after ejection from said weapon and exposure to ambient temperature.

2. The weapon of claim 1 wherein each of said storage areas defines a nozzle adapted to eject each of said two separated liquid streams in a beam having a diameter in a range of between 13 microns and 1.2 millimeters such that said two separated ejected streams solidify into fine conductive wires.

3. The weapon of claim 1 wherein said conductive material is metallic.

4. The weapon of claim 1 wherein said conductive material is a metal alloy.

5. The weapon of claim 4 wherein said alloy is a bismuth based alloy.

6. The weapon of claim 4 wherein said alloy is an indium-gallium based alloy.

7. The weapon of claim 1 further including means for heating said first and second storage areas above the melting point of said conductive material stored therein such that said conductive material can be stored in said first and second storage areas in solid form and thereafter heated to molten form for ejection from said housing in said two separated liquid streams.

8. The weapon of claim 7 further including temperature monitoring and control means operatively associated with said conductive material and said heating means for reading and adjusting the temperature of said conductive material in said first and second storage areas.

9. The weapon of claim 1 further including means for adjusting the potential difference of the voltage applied to said conductive material to adjust the electrical current delivered to said target.

10. The weapon of claim 1 wherein each of said first and second storage compartments terminates in a nozzle.

11. The weapon of claim 10 wherein each of said first and second storage areas is inwardly tapered in a direction towards said nozzle, and a filter is mounted behind said nozzle.

12. The weapon of claim 1 wherein said means for ejecting said conductive material simultaneously ejects said conductive material from each of said storage areas at substantially the same initial velocity.

13. The weapon of claim 1 further including means for cooling the liquid streams of conductive material ejected from said first and second storage areas to decrease time required for solidification of said two separated liquid streams.

14. The weapon of claim 12 wherein said means for ejecting said conductive material comprise a movable member disposed in each of said storage areas and means for selectively moving said movable member against said conductive material for applying a force on said conductive material.

15. A non-lethal weapon for delivering an electric current to a living target, said weapon comprising:

a housing for storing electrically conductive material, means for ejecting said electrically conductive material from said housing in two separated liquid streams electrically isolated from each other, means for applying an electrical potential difference across said two ejected streams of conductive material, said conductive material existing in solid form at ambient temperatures such that said liquid streams solidify after ejection from said housing and exposure to ambient temperatures.

16. The weapon of claim 15 further including means for heating said electrically conductive material stored within said housing to a temperature at least equal to the melting temperature of said electrically conductive material.

17. A method of delivering an electric current to a living target including the steps of:

propelling an electrically conductive material in two separate liquid streams electrically isolated from each other, solidifying said two propelled liquid streams into two wires in flight towards said target, and applying a potential difference across said two wires to deliver an electric current to said target.

18. The method of claim 17 wherein said electrically conductive material is solid at ambient temperatures.

19. The method of claim 18 including the step of heating said electrically conductive material to a temperature at least equal to the melting point of said electrically conductive material before said electrically conductive material is propelled.

20. The method of claim 17 wherein said electrically conductive material includes at least one metal.

* * * * *